United States Patent [19]

Schmerler

[11] Patent Number: 4,894,871

[45] Date of Patent: Jan. 23, 1990

[54] TRANSFER AID

[76] Inventor: Joseph Schmerler, 140 Devon Rd., Tenafly, N.J. 07670

[21] Appl. No.: 304,467

[22] Filed: Feb. 1, 1989

[51] Int. Cl.[4] ..... A61H 3/00

[52] U.S. Cl. ..... 4/254; 135/67; 272/70.3

[58] Field of Search ..... 4/254, 571, 604, 611; 135/67; 272/70.3; 256/1, 59

[56] References Cited

U.S. PATENT DOCUMENTS

| | | | |
|---|---|---|---|
| 2,556,121 | 6/1951 | Thomas | 272/70.3 |
| 2,773,542 | 12/1956 | Chasin | 4/254 |
| 3,047,884 | 8/1962 | Grondona | 4/254 |
| 3,090,051 | 5/1963 | Oakland | 4/254 |
| 3,383,714 | 5/1968 | Minasian et al. | 4/254 |
| 3,619,820 | 11/1971 | Cain et al. | 4/254 |
| 4,135,535 | 1/1979 | Thomas | 135/67 |
| 4,314,576 | 2/1982 | McGee | 135/67 |
| 4,474,202 | 10/1984 | Blechner | 135/67 |
| 4,587,678 | 5/1986 | Love et al. | 4/251 |
| 4,685,157 | 8/1987 | James | 4/254 |

FOREIGN PATENT DOCUMENTS

| | | | |
|---|---|---|---|
| 1208432 | 2/1960 | France | 4/254 |

*Primary Examiner*—Henry J. Recla
*Assistant Examiner*—R. M. Fetsuga
*Attorney, Agent, or Firm*—Natter & Natter

[57] ABSTRACT

A transfer aid includes a space frame releasably securable to a commode having a series of assist bars within hand-reachable distance from the commode user. The assist bars are grasped for initiating pivotable weight transference and for providing lift support during movement from a seated to a standing position. The space frame also includes a footpad for weight distribution to stabilize the space frame.

12 Claims, 2 Drawing Sheets

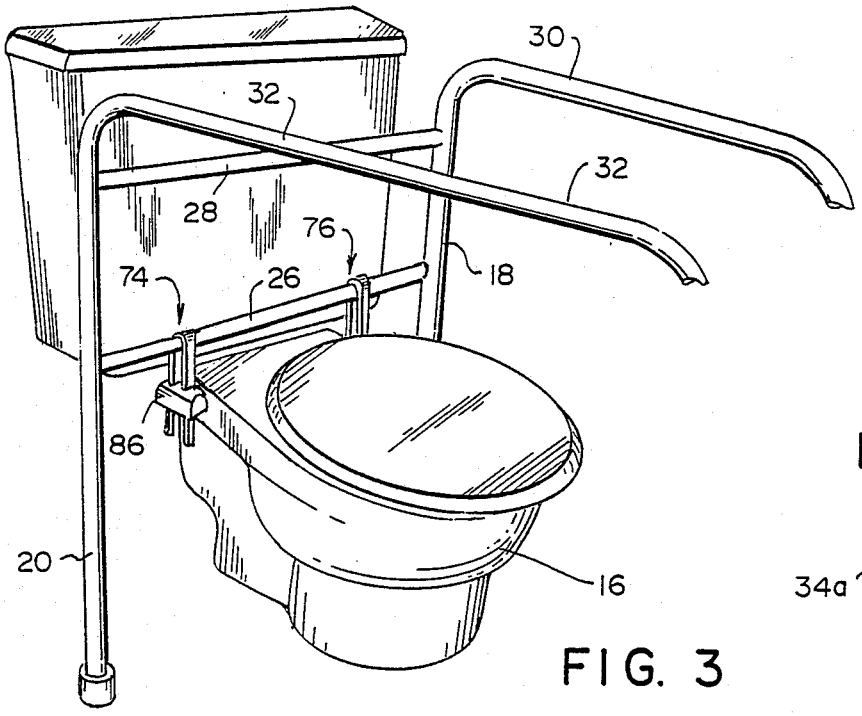
FIG. 3
FIG. 6
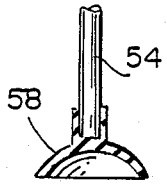
FIG. 7
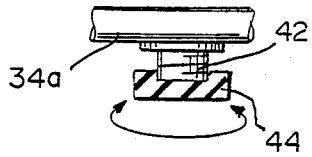
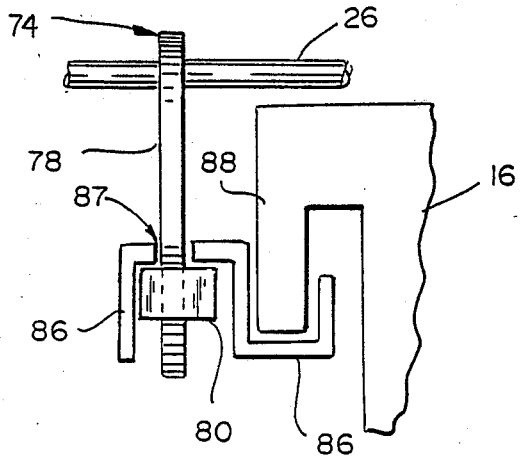
FIG. 4
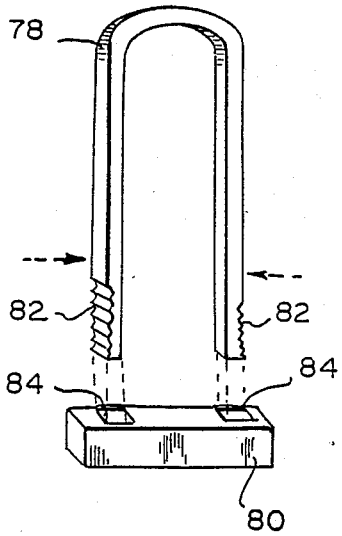
FIG. 5

TRANSFER AID

TECHNICAL FIELD

This invention relates generally to ambulation appliances for physically impaired individuals and especially to an aid for assisting weight transfer during transition from a seated to a standing position.

In particular, the transfer aid of this invention provides a space frame for use in shifting an individual's center of gravity about a fulcrum and for achieving progressive bearing adjustment to an erect attitude.

BACKGROUND ART

Various health care appliances have been developed for assisting senior citizens, infirm, and disabled individuals in the performance of daily functions. With regard to bathroom aids, some of those devices included grab bars, hand grips and safety rails for facilitating bathtub entry and exit and for use in other areas of a bathroom. A deficiency of those devices however, was that they required muscular strength within the hand and upper arm and some degree of manual dexterity. Furthermore, those devices were not particularly adapted for commode usage.

Aids such as elevated toilet seats and adjustable seat heights as well as toilet guard rails and arm rests provided some assistance and confidence to the commode user. A shortcoming of the aforementioned appliances was that they were not directed to assisting weight transfer during the transition from a sitting to a standing position. Another disadvantage of those previous devices was that the utilization thereof required muscular strength in the legs and upper body. There was also a tendency for those devices to tip or slide on a smooth bathroom floor surface.

BRIEF SUMMARY OF THE INVENTION

The transfer aid of this invention relies upon a weight transference about a fulcrum for effecting a pivotal dislocation. This movement can be achieved with a minimal amount of muscular exertion and utilizes an apparatus which provides a self-stabilized support.

The transfer aid of this invention includes a space frame comprised of parallel rail members. A rear section of the space frame is adapted to surround a commode. A front section of the space frame is provided with a plurality of assist bars within hand-reachable distance from the commode user. An intermediate section of the space frame provides transitional weight bearing support.

The assist bars are utilized in conjunction with a foot pad for accomplishing a weight transfer and lift support. The foot pad further distributes the weight-load to a horizontal support surface. The interface between the space frame and the horizontal support surface includes adjustable levelers for providing contiguous surface contact.

A feature of the transfer aid of this invention is that a minimal muscular effort is required during weight transfer.

Additionally, a further advantageous feature of this invention is that it is adapted for use as a temporary installation.

Another advantage of this invention is that the space frame is self-stabilized by the weight of the individual as transmitted through the foot pad.

Having thus summarized the invention, it will be seen that it is an object thereof to provide a transfer aid of the general character described herein which is not subject to the aforementioned disadvantages.

Another object of this invention is to provide a transfer aid that provides for pivotal weight transfer and lift support for assisting movement from a sitting to an erect position.

A further object of this invention is to provide a transfer aid which is removably attachable to a commode.

Another object of this invention is to provide a transfer aid which is self-stabilizing.

Still another object of this invention is to provide a transfer aid which is simple in construction, reliable in use and well adapted for mass production fabrication techniques.

Other objects of this invention in part will be apparent and in part will be pointed out hereinafter.

With these ends in view, the invention finds embodiment in certain combinations of elements and arrangement of parts for which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which is shown an exemplary embodiment of the invention:

FIG. 3 is a perspective view showing a portion of the space frame including a commode clip and a commode clamp for securement to a toilet bowl;

FIG. 4 is a partial sectional view to an enlarged scale, showing in detail the engagement of the commode clip with a lip of the toilet bowl;

FIG. 5 is an exploded perspective view of the commode clamp illustrating a U-shaped clasp and a locking bar;

FIG. 6 is a sectional view illustrating the suction cup tipped leg for the space frame; and FIG. 7 is a sectional view illustrating the adjustable height leveler for the space frame.

DETAILED DESCRIPTION OF THE INVENTION

Figure 1:
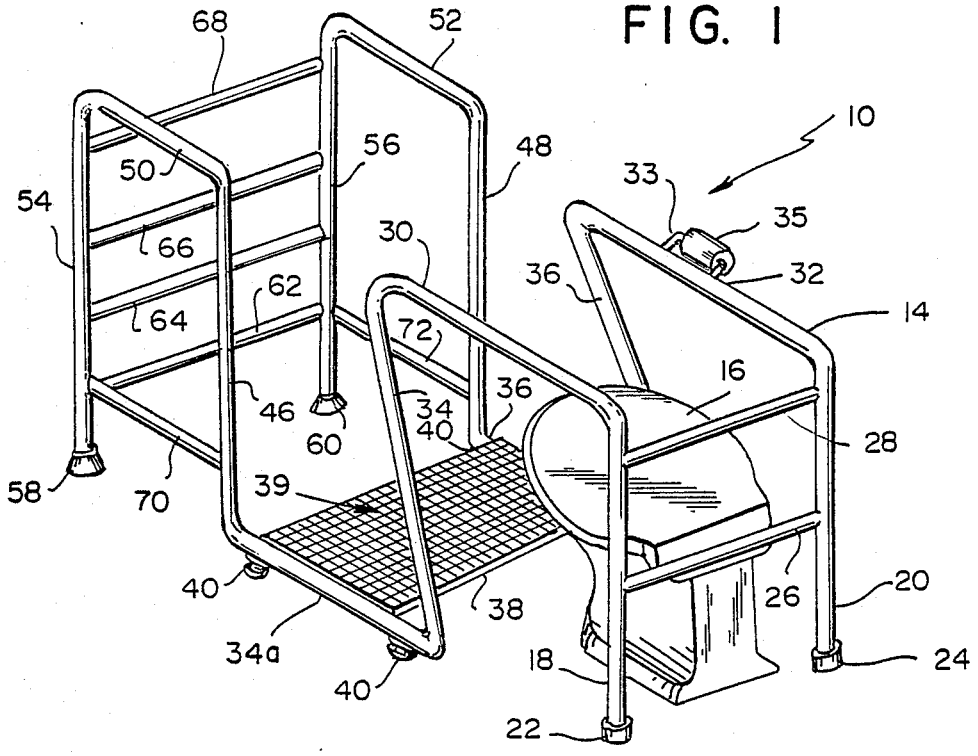
FIG. 1 is a perspective view of the transfer aid of this invention showing a typical application as used in conjunction with a commode.

Referring now in detail to the drawings, the reference numeral 10 denotes generally an improved transfer aid in accordance with this invention.

The transfer aid 10 is intended for use by elderly, infirm, and physically impaired individuals and will be discussed hereinafter in connection with commode usage. It should be understood however, that this device could be applied to stools, chairs and other sitting devices.

The transfer aid 10 includes a support frame 12 having a set of parallel tubular members 14. The tubular members 14 are preferably each comprised of a continuous curved length of heavy gage steel, for example, 1 in. (outside diameter), stainless steel or chrome-plated tubing. Alternatively, the curvature shown by the tubular members 14 can be formed by discrete lengths of tubular sections coupled together in the general configuration as shown herein.

Referring to FIG. 1, a rear section of the support frame 12 is shown surrounding a commode 16. The frame 12 is partially supported by two substantially vertical legs 18, 20 each having at their respective end, a friction tip 22, 24 of rubber, polyethylene or similar polymer material. A lower rear cross bar 26 and an upper rear cross bar 28 each approximately 20 inches in length, provide structural rigidity and generally reinforce the frame 12.

The respective legs 18, 20 extend approximately 28 inches in height and then are directed in a generally horizontal direction to define a pair of guard rails 30, 32. The guard rails 30, 32 provide an arm rest for the commode user and also restrict unintentional lateral movement by the user. As an added convenience, the guard rail 30 includes a bracket 33 for accommodating a roll of toilet tissue 35.

As further noted in FIG. 1, the guard rails 30, 32 curve downwardly at their forward most end to define a pair of inclined or diagonal members 34, 36, respectively. The members 34, 36 then assume a substantially horizontal direction as illustrated by rail sections **34*a*, 36*a*. A platform or footpad 38 is supported between the sections 34*a*, 36*a* and is designed to provide transitional weight bearing support. The footpad 38 is attached to the sections 34*a*, 36*a* by bolts, rivets, welds or equivalent fasteners. An upper surface 39 of the footpad 38** is textured or covered to provide a nonslip grid.

It should also be noted that the sections **34*a*, 36*a* are provided with two sets of adjustable levelers 40. As shown in FIG. 7, each of the levelers 40 include a threaded stud 42 extending from the section 34*a*, 36*a*, and a rotatable foot member 44 which engages with the threaded stud 42. It should thus be apparent that rotation of the foot member 44 will be effective for changing the height of the leveler 40 to provide smooth contact with a horizontal support surface 90 such as a bathroom floor. By way of example, the sections 34*a*, 36*a* are about 22 inches in length. The adjustable levelers 40 may also be used as an alternative to the friction tip 22, 24**.

A front section of the support frame 20 includes a set of upright members 46, 48 each being an extension of the respective sections **34*a*, 36*a*. The members 46, 48 are each preferably 33 inches in height and include a bend for extension in a substantially normal direction to define a pair of horizontal hand rails 50, 52. Each of the hand rails 50, 52** is approximately 12 inches in length.

A pair of front legs 54, 56 depend vertically downward from the hand rails 50, 52. The legs 54, 56 are tipped with respective suction cups 58, 60 of rubber, polyethylene or equivalent material, for providing a firm grip with the support surface 90. By way of example, the front legs 54, 56 are each 33 inches in length.

Figure 2:
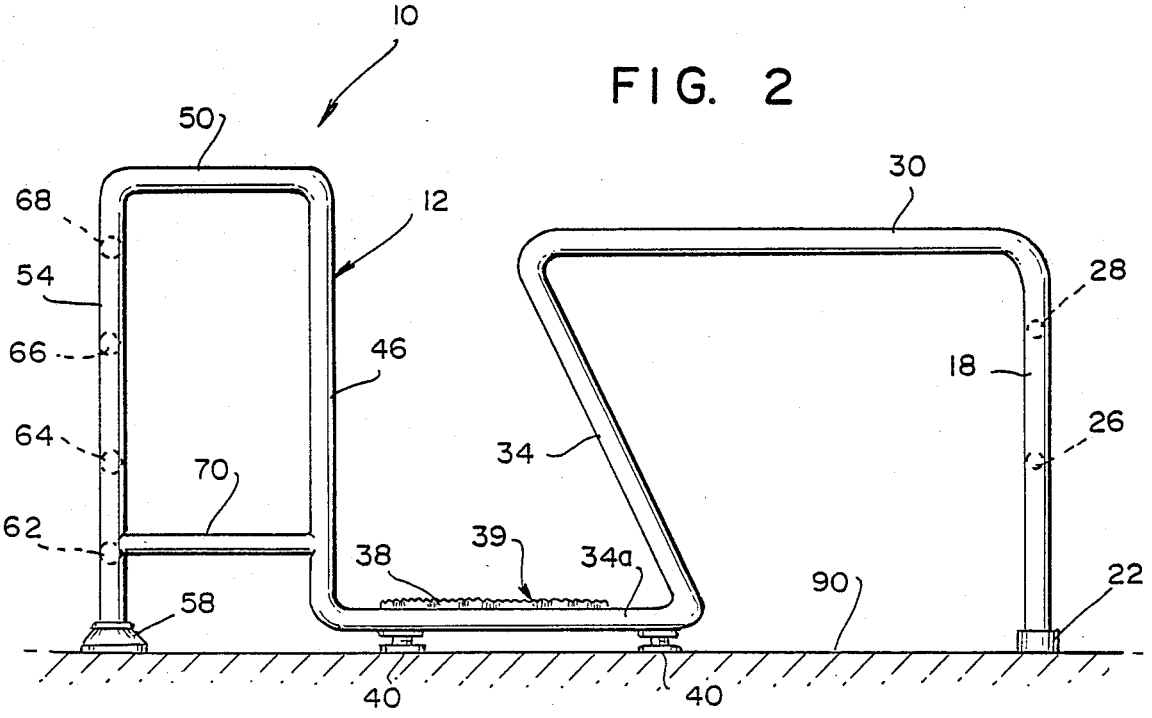
FIG. 2 is an elevational view showing a space frame including an adjustable leveler, a rubber tipped leg and a suction cup tipped leg interfacing with a support surface.

A plurality of assist bars 62, 64, 66 and 68 span horizontally between the front legs 54, 56 as shown in FIGS. 1 and 2. The approximate length of the assist bars 62–68 is 20 inches; the lower most bar 62 is approximately 5 inches from the support surface 90 and each of the respective bars 64, 66 and 68 are spaced 8 inches apart. The upper most bar 68 is positioned approximately 4 inches below the hand rails 50, 52.

It should be additionally noted that a pair of brace members 70, 72 extend between the legs 54, 56 and the upright members 46, 48 for providing a structural integrity to the frame 12. The horizontal distance between the legs 54, 56 and the legs 18, 20 is about 44 inches such that the assist bars 62–68 are within a hand-reachable distance from the commode 16. The assist bars 62–68, the brace members 70, 72 and the lower and upper cross bars 26, 28 are preferably fabricated of a tubing similar to that used for the rails 14.

As will be observed in FIGS. 1 and 2, the guard rails 30, 32, at the forward most end, overhang the footpad 38, and extend to approximately 10 inches from the upright members 46, 48. This is an additional safety feature and provides lateral or sidewise support for the user, especially when in the standing position.

The support frame 12 is secured to the commode 16 by a set of commode clamps 74, 76. The clamps 74, 76 are identical in function and operation and as shown in FIG. 5, are comprised of a flexible U-shaped clasp 78 and a locking bar 80. The clasp 78 includes a plurality of teeth 82 which are engageable within a keeper aperture 84 in the locking bar 80 when inserted therein. In order to release the clasp 78 an inwardly directed pressure (as shown by the arrows) is applied so as to disengage the teeth 82 from the keeper 84.

The clasp 78 is intended to straddle the lower rear cross bar 26 in supportable attachment as shown in FIG. 3. A commode clip 86 (see FIG. 4) is adapted to engage a lip 88 of the commode 16 and includes an opening 87 through which the clasp 78 can be inserted before engaging the locking bar 80. It should be apparent that the clamps 74, 76 are readily releaseable from the commode 16. Thus the transfer aid 10 can be removed for cleaning the supporting surface 90 or for installation at other locations.

When in use, the support frame 12 is placed in contiguous contact with the support surface 90 by utilizing the adjustable levelers 40. In operation, the commode user's feet are placed on the footpad 38 while in a seated position. When the user desires to stand, he leans forward and grabs one of the assist bars 62 through 68 and pulls back on the respective assist bar or leans forward and straightens his legs. This action shifts the center of gravity forwardly and the user's weight is gradually transferred to the footpad 38. By further pulling on the selected assist bar, the user's body is pivoted about the foot-pad 38 which acts as a fulcrum. The weight-load of the user is simultaneously distributed through the rubber tipped legs, 18, 20; the suction cup tipped legs 54, 56 and the adjustable levelers 40, to the support surface 90. This weight distribution prevents the frame 12 from tipping either forward or backward or from sliding during this procedure.

The user, at this stage, is in a bent over position and achieves lift support to attain an erec attitude by sequentially placing his hands on progressively higher assist bars e.g. 64, 66, 68 until arriving at the hand rails 52, 54 and thus assuming a standing position.

It should thus be seen that there is provided a transfer aid which achieves the various objects of this invention and which is well adapted to meet conditions of practical use.

Since various possible embodiments might be made of the present invention or modifications might be made to the exemplary embodiments set forth, it is to be understood that all material shown and described in the accompanying drawings are to be interpreted as illustrative and not in a limiting sense.

Having thus described in the invention, there is claimed as new and desired to be secured by Letters Patent:

1. A transfer aid for assisting weight transfer between a seated and a standing position comprising an integral space frame enclosing an interior of the transfer aid, said space frame including a rear section adapted to surround and be secured to a commode, a front section positioned forwardly therefrom for providing lift support, and an intermediate section connecting said front and rear sections for providing a transitional weight bearing support, said front section including at least one assist bar adapted for hand reachable grasp by the commode user to initiate a pivotal movement from a seated to a standing position, said support of said intermediate section including a footpad secured thereto for stabilizing said frame with respect to a horizontal support surface by the weight of the user on said footpad when in transition from said seated to said standing positions, said space frame further including at least one user access opening, said access opening located between the rear and front sections for allowing access to the interior of the transfer aid proximate the footpad.

2. A transfer aid as claimed in claim 1 wherein the front section includes a plurality of assist bars, said assist bars being located at progressively increasing heights above the support surface to provide lift support for the user while attaining the standing position.

3. A transfer aid as claimed in claim 2 wherein the front section further includes horizontal hand rails, said hand rails being above the assist bars.

4. A transfer aid as claimed in claim 3 wherein the front section includes two forward legs, said assist bars being mounted substantially horizontally between said legs.

5. A transfer aid as claimed in claim 1 further including clamp means for releasably securing the rear section to the commode.

6. A transfer aid as claimed in claim 5 wherein the clamp means includes a clasp and a locking bar, said clasp being adapted for locking engagement with the locking bar.

7. A transfer aid as claimed in claim 6 further including a commode clip for engagement with a lip of the commode, said clip being retained by the clamp means.

8. A transfer aid as claimed in claim 6 wherein the clamp means is supportably attached to the rear section of the space frame.

9. A transfer aid as claimed in claim 1 wherein the rear section includes two substantially vertical legs and guard rail means for providing armrest support for the commode user.

10. A transfer aid as claimed in claim 9 wherein the guard rail means includes a bracket for retaining a roll of toilet tissue.

11. A transfer aid as claimed in claim 1 further including leveler means for providing contiguous contact between the space frame and the support surface.

12. A transfer aid as claimed in claim 9 wherein the guard rail means extends over the footpad for providing material support to the user while standing.

* * * * *